US011527393B2

(12) United States Patent
Shichi

(10) Patent No.: US 11,527,393 B2
(45) Date of Patent: Dec. 13, 2022

(54) SPECTRUM CALCULATION PROCESSING DEVICE, SPECTRUM CALCULATION PROCESSING METHOD, ION TRAP MASS SPECTROMETRY SYSTEM, ION TRAP MASS SPECTROMETRY METHOD AND NON-TRANSITORY COMPUTER READABLE MEDIUM STORING SPECTRUM CALCULATION PROCESSING PROGRAM

(71) Applicant: Shimadzu Corporation, Kyoto (JP)

(72) Inventor: Hideharu Shichi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 16/599,475

(22) Filed: Oct. 11, 2019

(65) Prior Publication Data

US 2020/0185206 A1 Jun. 11, 2020

(30) Foreign Application Priority Data

Dec. 5, 2018 (JP) ..... JP2018-228515

(51) Int. Cl.
*H01J 49/00* (2006.01)
*H01J 49/16* (2006.01)
*H01J 49/42* (2006.01)

(52) U.S. Cl.
CPC ..... *H01J 49/0036* (2013.01); *H01J 49/164* (2013.01); *H01J 49/4245* (2013.01)

(58) Field of Classification Search
CPC ... H01J 49/0036; H01J 49/164; H01J 49/2425
(Continued)

(56) References Cited

U.S. PATENT DOCUMENTS 6,909,981 B2 * 6/2005 Gavin ..... H01J 49/0036 702/67
8,073,635 B2 * 12/2011 Thomson ..... H01J 49/0009 702/23

(Continued)

FOREIGN PATENT DOCUMENTS

JP 2007-005303 A 1/2007
JP 2008-070122 A 3/2008

(Continued)

OTHER PUBLICATIONS

Extended European Search Report dated Apr. 9, 2020 in European Patent Application No. 19201996.6, 8 pages.

(Continued)

*Primary Examiner* — Wyatt A Stoffa
(74) *Attorney, Agent, or Firm* — Oblon, McClelland, Maier & Neustadt, L.L.P.

(57) ABSTRACT

A spectrum acquirer acquires a plurality of mass spectrums. A specific physical quantity calculator calculates a specific physical quantity reflecting an amount of ions with respect to each of the plurality of obtained mass spectrums. A spectrum sorter sorts the plurality of mass spectrums in order of the specific physical quantity calculated with respect to each mass spectrum. A display controller allows a display to display the plurality of sorted mass spectrums. A spectrum selector selects a plurality of mass spectrums having specific physical quantities in a designated range from the plurality of displayed mass spectrums. A post-selection spectrum integrator integrates the plurality of selected mass spectrums. The display controller allows the display to display the post-selection integrated mass spectrum.

20 Claims, 6 Drawing Sheets

(58) Field of Classification Search
USPC ..... 250/283
See application file for complete search history.

(56) References Cited

U.S. PATENT DOCUMENTS

| | | | | |
|---|---|---|---|---|
| 10,788,469 | B2 * | 9/2020 | Yamamura ..... | G01N 30/7206 |
| 2007/0023642 | A1 | 2/2007 | Altmayer | |
| 2008/0061226 | A1 | 3/2008 | Satoh | |
| 2010/0065740 | A1 | 3/2010 | Iwamoto et al. | |
| 2012/0326027 | A1 | 12/2012 | Sugiyama et al. | |
| 2013/0338935 | A1 | 12/2013 | Watanabe et al. | |
| 2015/0206728 | A1 | 7/2015 | Kaneko et al. | |

FOREIGN PATENT DOCUMENTS

| | | | |
|---|---|---|---|
| JP | 2013-007637 | A | 1/2013 |
| JP | 2014-059975 | A | 4/2014 |
| WO | WO 2008/129850 | A1 | 10/2008 |

OTHER PUBLICATIONS

Olson, M.T., et al., "Evaluating Reproducibility and Similarity of Mass and Intensity Data in Complex Spectra—Applications to Tubulin ", Journal of the American Society for Mass Spectrometry. Elsevier Science Inc., U.S., vol. 19, No. 3. Nov. 23, 2007, pp. 367-374.

Office Action dated Mar. 15, 2022 in corresponding Japanese Patent Application No. 2018-228515 (with English-language Translation), 11 pages.

* cited by examiner

SPECTRUM CALCULATION PROCESSING DEVICE, SPECTRUM CALCULATION PROCESSING METHOD, ION TRAP MASS SPECTROMETRY SYSTEM, ION TRAP MASS SPECTROMETRY METHOD AND NON-TRANSITORY COMPUTER READABLE MEDIUM STORING SPECTRUM CALCULATION PROCESSING PROGRAM

BACKGROUND OF THE INVENTION

Field of the Invention

The present invention relates to a spectrum calculation processing device that performs calculation processing of a plurality of spectrums, an ion trap mass spectrometry system including the spectrum calculation processing device, a spectrum calculation processing method, an ion trap mass spectrometry method using the spectrum calculation processing method and a non-transitory computer readable medium storing a spectrum calculation processing program.

Description of Related Art

Ion trap mass spectrometers that use ion traps capturing ions by electric fields have been known. For example, WO 2008/129850 A1 describes a Matrix Assisted Laser Desorption/Ionization Digital Ion Trap Mass Spectrometer (MALDI-DIT-MS). In the ion trap mass spectrometer, ions are produced by irradiating a sample with laser light. The produced ions are introduced and captured in an ion trap, and then the ions having mass-to-charge ratios (m/z) in a range to be analyzed are discharged from the ion trap and detected by an ion detector. A mass spectrum is obtained based on a detection signal output from the ion detector.

The mass spectrum obtained by such an ion trap mass spectrometer is influenced by the space charges in the ion trap. In the mass spectrometry described in JP 2013-7637 A, a mass axis of a mass spectrum is corrected based on an amount of ions accumulated in an ion trap at the time of discharge of the ions.

BRIEF SUMMARY OF THE INVENTION

However, the space charges in the ion trap influences not only the mass axis of the mass spectrum but also the width of each peak and so on. For example, when an MALDI ion source is used, the amount of ions that are produced each time a sample is irradiated with laser light varies largely depending on a crystalline state of a sample. A plurality of mass spectrums obtained by irradiating a sample with laser light multiple times, are integrated in order to improve the S/N (signal/noise) ratio of the mass spectrum. In this case, when the widths of corresponding peaks in the plurality of mass spectrums vary, a good mass spectrum is not obtained after integration.

An object of the present invention is to provide a spectrum calculation processing device, a spectrum calculation processing method, an ion trap mass spectrometry system, an ion trap mass spectrometry method and a non-transitory computer readable medium storing a spectrum calculation processing program that enable a good mass spectrum to be obtained easily based on a plurality of mass spectrums obtained by ion trap mass spectrometry.

(1) A spectrum calculation processing device according to one aspect of the present invention includes a spectrum acquirer that acquires a plurality of mass spectrums obtained by ion trap mass spectrometry with respect to a same sample, a specific physical quantity calculator that calculates a physical quantity reflecting an amount of ions as a specific physical quantity with respect to each of the plurality of mass spectrums acquired by the spectrum acquirer, a spectrum sorter that sorts the plurality of mass spectrums in order of the specific physical quantity calculated with respect to each mass spectrum, a first display controller that allows a display to display the plurality of sorted mass spectrums, a spectrum selector that selects a plurality of mass spectrums having specific physical quantities in a designated range from the plurality of displayed mass spectrums, a spectrum integrator that integrates the plurality of selected mass spectrums, and a second display controller that allows the display to display an integrated mass spectrum obtained by the spectrum integrator.

With the spectrum calculation processing device, the plurality of mass spectrums are sorted in order of the specific physical quantity reflecting the amount of ions, and displayed in the sorting order. Thus, the user can identify the specific physical quantity range in which a good mass spectrum is obtained by viewing the plurality of mass spectrums displayed in order of the specific physical quantity. The plurality of mass spectrums having the specific physical quantities in the range designated by the user are selected, and the plurality of selected mass spectrums are integrated. Thus, a good mass spectrum is obtained by integration. In this case, it is not necessary to correct the plurality of mass spectrums. Further, it is not necessary to adjust an analysis condition in order to reduce influence by the space charges in the ion trap. Therefore, a good mass spectrum can be obtained easily based on the plurality of mass spectrums obtained by the ion trap mass spectrometry.

(2) The spectrum calculation processing device may further include a storage that stores the mass spectrum obtained by the spectrum integrator, and the specific physical quantity range that is used for selection of the plurality of mass spectrums by the spectrum selector.

In this case, the good integrated mass spectrum and the specific physical quantity range for obtaining the good mass spectrum are stored. Thus, at the time of analysis of another sample of the same type, the plurality of mass spectrums to be used for integration can be selected based on the stored range of the specific physical quantity. Therefore, in the analysis that is carried out a plurality of times, the reference for selection of the plurality of mass spectrums used for integration can be constant. Further, an analysis method including the range of the specific physical quantity as one of analysis conditions can be created easily.

(3) The specific physical quantity may include an integral charge quantity in a specific mass-to-charge ratio range with respect to each mass spectrum. In this case, the integral charge quantity in the specific mass-to-charge ratio range with respect to the mass spectrum reflects the amount of ions in the ion trap. Therefore, it is possible to obtain a good mass spectrum by integration, by selecting a plurality of mass spectrums having integral charge quantities in an appropriate range.

(4) The spectrum calculation processing device may further include a mass-to-charge ratio range setter that sets the specific mass-to-charge ratio range. In this case, a good mass spectrum can be obtained in a desired range of the mass-to-charge ratio after the integration.

(5) A spectrum calculation processing method according to another aspect of the present invention includes acquiring a plurality of mass spectrums obtained by ion trap mass spectrometry with respect to a same sample, calculating a physical quantity that reflects an amount of ions as a specific physical quantity with respect to each of the plurality of acquired mass spectrums, sorting the plurality of mass spectrums in order of the specific physical quantity calculated with respect to each mass spectrum, allowing a display to display the plurality of sorted mass spectrums, selecting a plurality of mass spectrums having specific physical quantities in a designated range from the plurality of displayed mass spectrums, integrating the plurality of selected mass spectrums, and allowing the display to display an integrated mass spectrum.

(6) A non-transitory computer readable medium according to yet another aspect of the present invention, stores a spectrum calculation processing program, wherein the spectrum calculation processing program causes a computer to execute a process of acquiring a plurality of mass spectrums obtained by ion trap mass spectrometry with respect to a same sample, a process of calculating a physical quantity that reflects an amount of ions as a specific physical quantity with respect to each of the plurality of acquired mass spectrums, a process of sorting the plurality of mass spectrums in order of the specific physical quantity calculated with respect to each mass spectrum, a process of allowing a display to display the plurality of sorted mass spectrums, a process of selecting a plurality of mass spectrums having specific physical quantities in a designated range from the plurality of displayed mass spectrums, a process of integrating the plurality of selected mass spectrums, and a process of allowing the display to display an integrated mass spectrum.

(7) An ion trap mass spectrometry system according to yet another aspect of the present invention includes an ion trap spectrometer, and the above-mentioned spectrum calculation processing device that performs calculation processing with respect to a plurality of mass spectrums obtained by the ion trap mass spectrometer.

(8) An ion trap mass spectrometry method according to yet another aspect of the present invention includes obtaining a plurality of mass spectrums by ion trap mass spectrometry with respect to a same sample, and performing the above-mentioned spectrum calculation processing method with respect to the plurality of obtained mass spectrums.

Other features, elements, characteristics, and advantages of the present invention will become more apparent from the following description of preferred embodiments of the present invention with reference to the attached drawings.

DESCRIPTION OF THE PREFERRED EMBODIMENTS

A spectrum calculation processing device, an ion trap mass spectrometry system including the spectrum calculation processing device, a spectrum calculation processing method, an ion trap mass spectrometry method using the spectrum calculation processing method and a non-transitory computer readable medium storing a spectrum calculation processing program according to embodiments of the present invention will be described below in detail with reference to drawings.

(1) Configuration of Ion Trap Mass Spectrometry System

Figure 1:
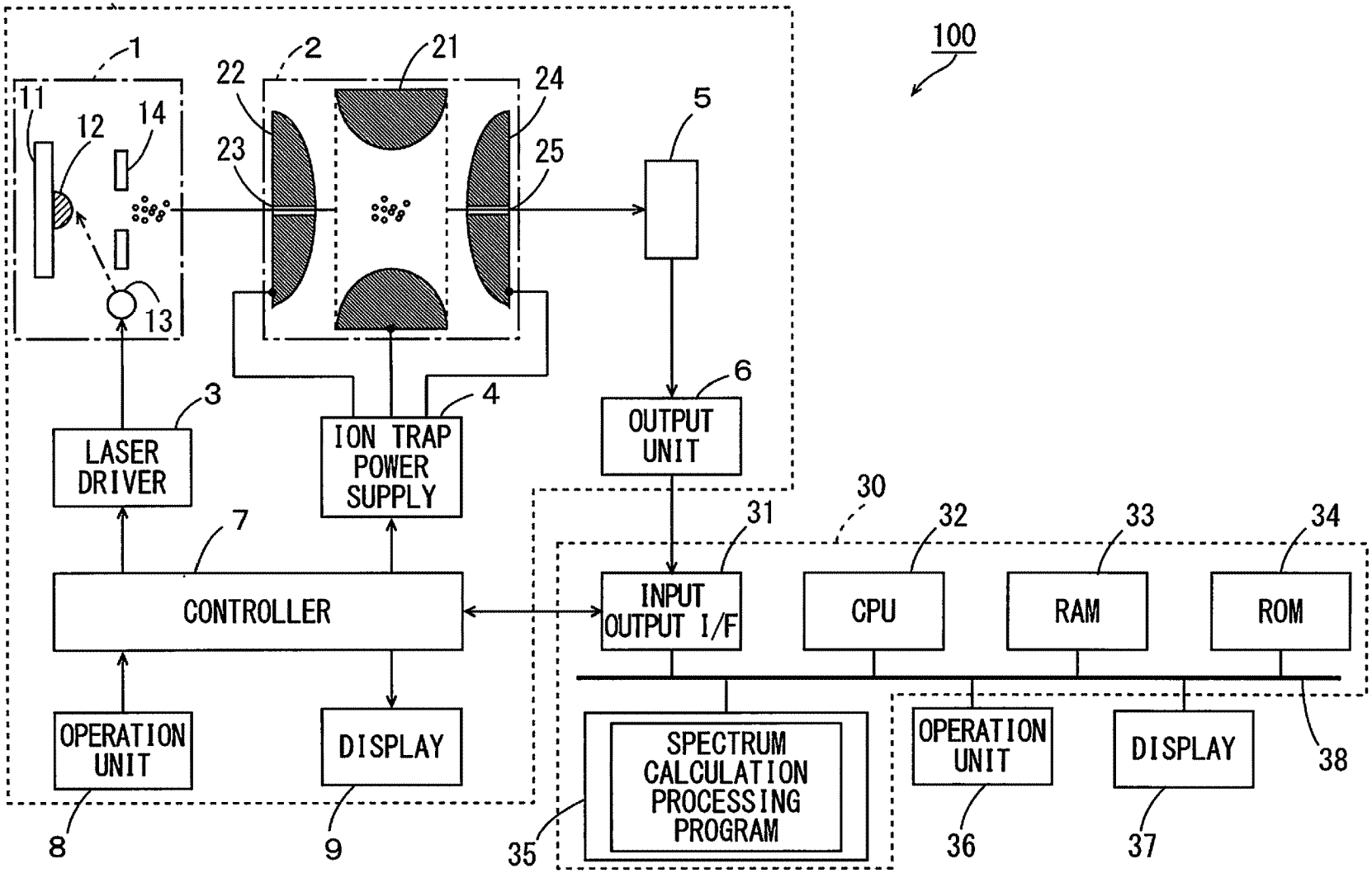
FIG. 1 is a schematic diagram showing the configuration of an ion trap mass spectrometry system according to one embodiment of the present invention.

FIG. 1 is a schematic diagram showing the configuration of the ion trap mass spectrometry system according to one embodiment of the present invention. The ion trap mass spectrometry system 100 of FIG. 1 includes an ion trap mass spectrometer 10 and the spectrum calculation processing device 30. In the present embodiment, the ion trap mass spectrometer 10 is a Matrix Assisted Laser Desorption/Ionization Digital Ion Trap Mass Spectrometer (MALDI-DIT-MS).

The ion trap mass spectrometer 10 includes an ion source 1, an ion trap 2, a laser driver 3, an ion trap power supply 4, an ion detector 5, an output unit 6, a controller 7, an operation unit 8 and a display 9. In the present embodiment, the ion source 1 is a MALDI ion source. The controller 7 controls the laser driver 3 and the ion trap power supply 4.

The ion source 1 includes a sample plate 11, a laser irradiator 13 and an extraction electrode 14. A sample 12 mixed with a matrix is prepared on the sample plate 11. The laser driver 3 drives the laser irradiator 13. Thus, the laser irradiator 13 irradiates the sample 12 on the sample plate 11 with pulse-form laser light. As a result, various components included in the sample 12 are ionized. The produced ions are extracted by an electric field, which is formed between the sample plate 11 and the extraction electrode 14, for extracting ions.

In the present embodiment, the ion trap 2 is a three-dimensional quadrupole ion trap. The ion trap 2 includes a ring electrode 21 and a pair of end-cap electrodes 22, 24. The pair of end-cap electrodes 22, 24 is provided to be opposite to each other with the ring electrode 21 provided therebetween. An ion introduction port 23 is provided at substantially the center of the end-cap electrode 22. An ion discharge port 25 is provided at substantially the center of the end-cap electrode 24. The ions extracted from the ion source 1 are introduced into the ion trap 2 through the ion introduction port 23.

The ion trap power supply 4 applies a square-wave voltage to the ring electrode 21 as a capturing voltage. Thus, a capturing electric field that captures ions in the ion trap 2 while oscillating the ions is formed. With the square-wave voltage applied to the ring electrode 21, a high-frequency signal having a predetermined frequency is applied to the end-cap electrodes 22, 24 by the ion trap power supply 4. Thus, the ions having a specific mass are resonantly excited (excitation). The resonantly excited ions are discharged from the ion discharge port 25.

The controller 7 changes the frequency of the capturing voltage to be applied to the ring electrode 21 and the frequency of an auxiliary voltage to be applied to the end-cap electrodes 22, 24. Thus, the mass-to-charge ratio of the ions to be discharged from the ion discharge port 25 sequentially changes.

The ions discharged from the ion discharge port 25 are introduced into the ion detector 5. The ion detector 5 includes a conversion dynode and a secondary electron multiplier, for example, and outputs the electric charges corresponding to the amount of detected ions as a detection signal. The detection signal that is output from the ion detector 5 is supplied to the output unit 6. The output unit 6 produces a mass spectrum (hereinafter abbreviated as a spectrum) by converting the detection signal into digital data. The display 9 displays the spectrum supplied by the output unit 6 through the controller 7 and various data. A user uses the operation unit 8 to give various instructions to the controller 7.

The spectrum calculation processing device 30 is constituted by an input output I/F (interface) 31, a CPU (Central Processing Unit) 32, a RAM (Random Access Memory) 33, a ROM (Read Only Memory) 34 and a storage device 35, and is a personal computer or a server, for example. The input output I/F 31, the CPU 32, the RAM 33, the ROM 34 and the storage device 35 are connected to a bus 38. The input output I/F 31 is connected to the output unit 6 and the controller 7 of the ion trap mass spectrometer 10.

The operation unit 36 includes a keyboard, a pointing device and so on, and is used for inputting various data, etc., and various types of operations. The display 37 includes a liquid crystal display, an organic electroluminance display or the like, and displays spectrums and various information and images. The operation unit 36 and the display 37 may be constituted by a touch panel display.

The storage device 35 includes a storage medium such as a hard disc, an optical disc, a magnetic disc, a semiconductor memory or a memory card, and stores the spectrum calculation processing program, which is a computer program. The RAM 33 is used as a work area for the CPU 32. A system program is stored in the ROM 34. The CPU 32 executes the spectrum calculation processing program stored in the storage device 35 on the RAM 33, whereby the spectrum calculation processing, described below, is performed.

(2) Functional Configuration of Spectrum Calculation Processing Device 30

Figure 2:
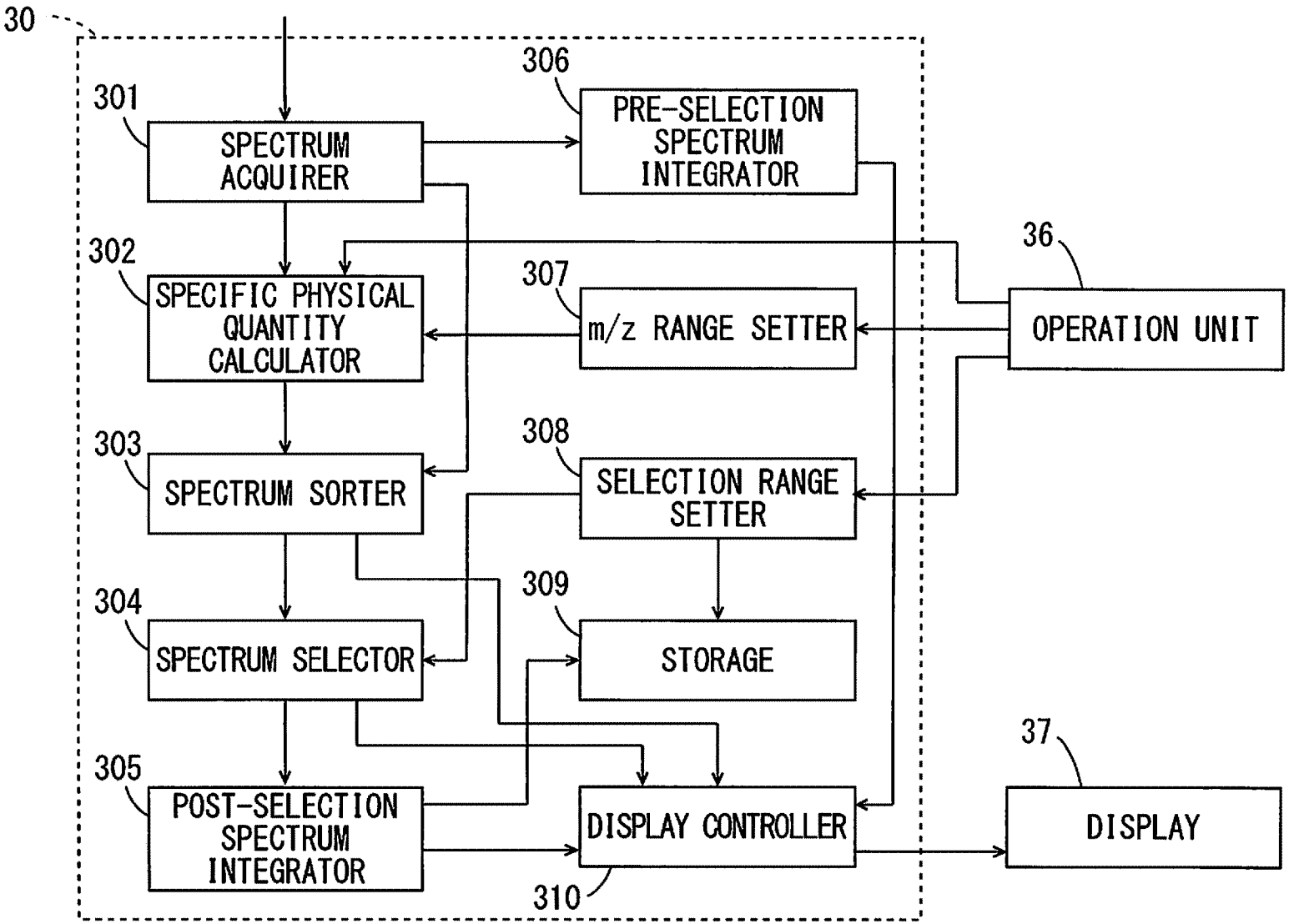
FIG. 2 is a block diagram showing the functional configuration of a spectrum calculation processing device in the ion trap mass spectrometry system of FIG. 1.

FIG. 2 is a block diagram showing the functional configuration of the spectrum calculation processing device 30 in the ion trap mass spectrometry system 100 of FIG. 1. In the present embodiment, a specific physical quantity is an integral charge quantity in a specific m/z (mass-to-charge ratio) range of a spectrum. The integral charge quantity is calculated from a total area of one or a plurality of peaks in the specific m/z range of the spectrum.

As shown in FIG. 2, the spectrum calculation processing device 30 includes a spectrum acquirer 301, a specific physical quantity calculator 302, a spectrum sorter 303, a spectrum selector 304, a post-selection spectrum integrator 305, a pre-selection spectrum integrator 306, an m/z range setter 307, a selection range setter 308, a storage 309 and a display controller 310. The above-mentioned constituent elements (301 to 310) are realized by execution of the spectrum calculation processing program stored in a storage medium (a recording medium) such as the storage device 35 by the CPU 32 of FIG. 1. Part or all of the constituent elements of the spectrum calculation processing device 30 may be realized by hardware such as an electronic circuit.

The user designates the specific m/z range (hereinafter abbreviated as an m/z range) using the operation unit 36. The m/z range setter 307 sets the m/z range designated using the operation unit 36. Further, the user designates a selection range of the specific physical quantity using the operation unit 36. In the present embodiment, the selection range of the integral charge quantity is set.

The spectrum acquirer 301 acquires a plurality of spectrums that are obtained by analysis that is carried out a plurality of times with respect to the same sample from the output unit 6 of the ion trap mass spectrometer 10 of FIG. 1, and saves the plurality of acquired spectrums. The pre-selection spectrum integrator 306 integrates the data of the plurality of spectrums obtained with respect to the same sample by the spectrum acquirer 301. The spectrum obtained by integration by the pre-selection spectrum integrator 306 is referred to as a pre-selection integrated spectrum.

The specific physical quantity calculator 302 calculates the physical quantity of peaks in the set m/z range in each spectrum acquired by the spectrum acquirer 301 as the specific physical quantity. In the present embodiment, the specific physical quantity calculator 302 calculates an integral charge quantity with respect to each spectrum by calculating the area of peaks in the set m/z range in each spectrum acquired by the spectrum acquirer 301.

The spectrum sorter 303 sorts a plurality of spectrums based on the integral charge quantity calculated by the specific physical quantity calculator 302 with respect to each spectrum. Specifically, the spectrum sorter 303 sorts (rearranges) the plurality of spectrums in descending or ascending order of the integral charge quantity. The spectrum selector 304 selects a plurality of spectrums having specific physical quantities in the selection range set by the selection range setter 308. The post-selection spectrum integrator 305 integrates the data of the plurality of spectrums selected by the spectrum selector 304. The spectrum obtained by integration by the post-selection spectrum integrator 305 is referred to as a post-selection integrated spectrum. In the present embodiment, the post-selection spectrum integrator 305 is an example of a spectrum integrator.

The storage 309 stores the post-selection integrated spectrum, the type of specific physical quantity (the integral charge quantity in the present embodiment) and the selection range (the designated range of the integral charge quantity in the present embodiment). The display controller 310 allows the display 37 to display the plurality of spectrums acquired by the spectrum acquirer 301, the pre-selection integrated spectrum obtained by the pre-selection spectrum integrator 306, the plurality of spectrums sorted by the sorter 303, the plurality of spectrums selected by the spectrum selector 304, and the post-selection integrated spectrum obtained by the post-selection spectrum integrator 305. In the present embodiment, the display controller 310 constitutes a first display controller and a second display controller.

(3) Spectrum Calculation Processing Program

Figure 3:
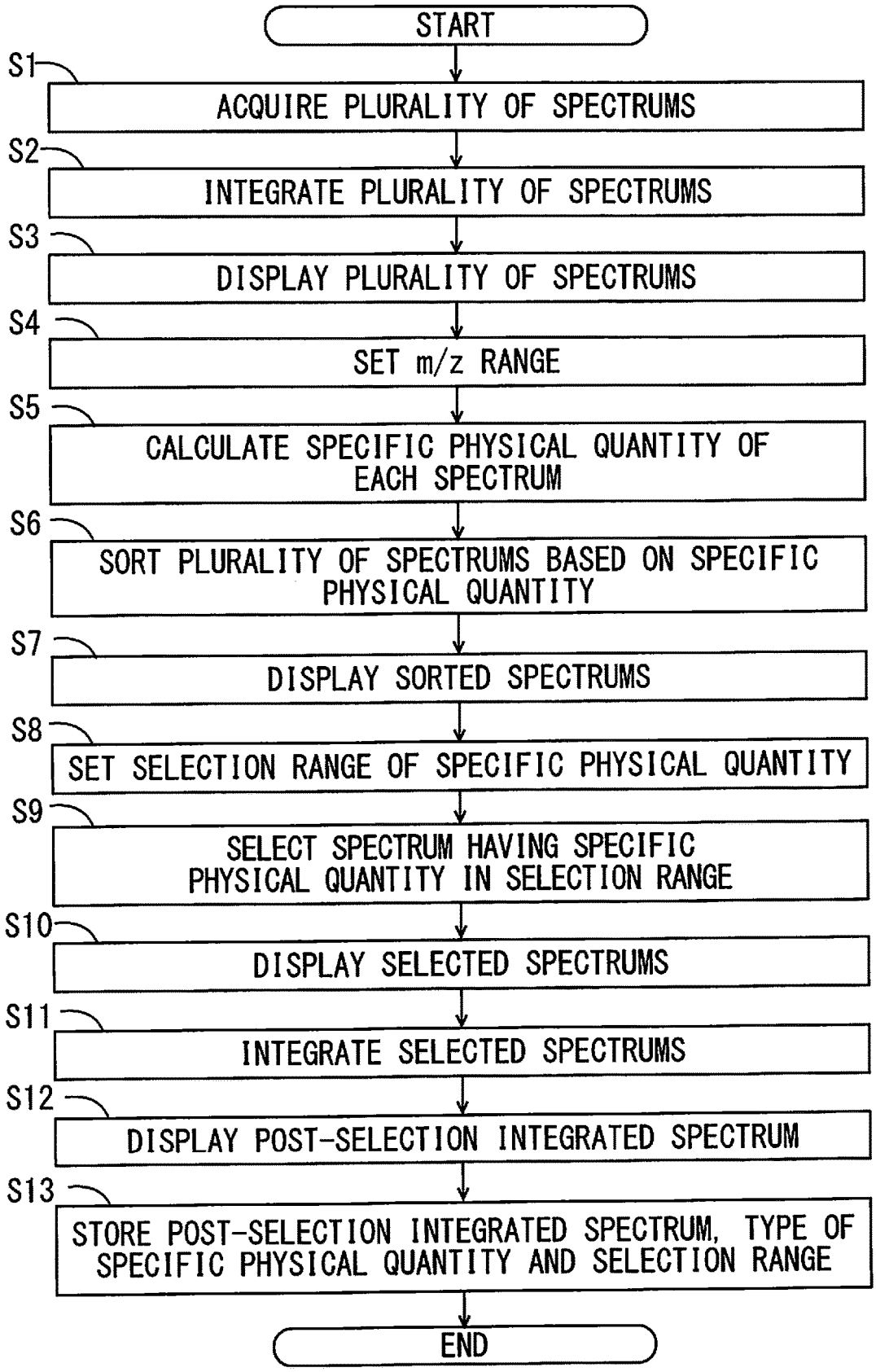
FIG. 3 is a flow chart showing the algorithm of a spectrum calculation processing program.
Figure 4:
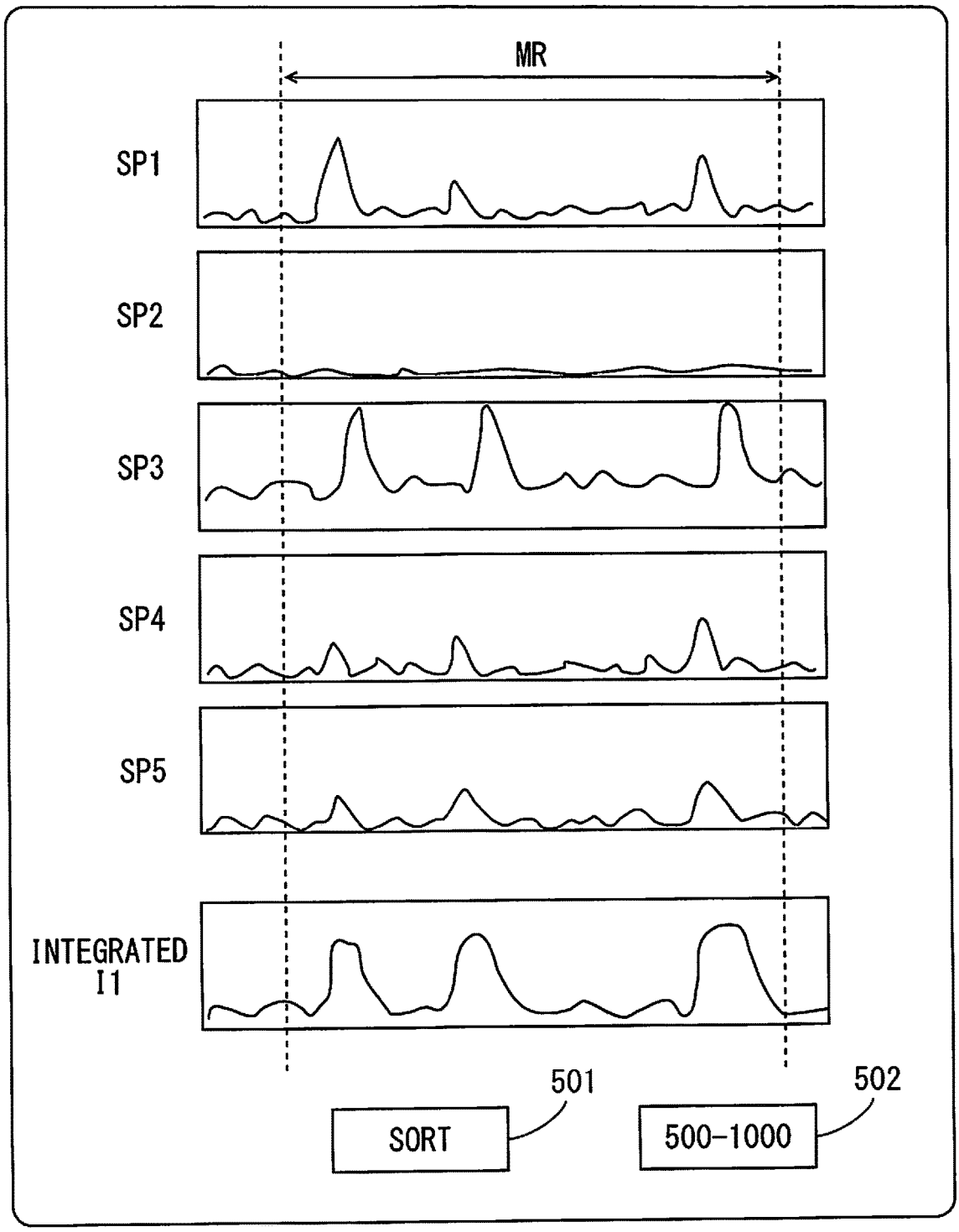
FIG. 4 is a schematic diagram showing an example of a display screen of a plurality of spectrums acquired from an ion trap mass spectrometer and a pre-selection integrated spectrum.

The spectrum calculation processing method is performed by execution of the spectrum calculation processing program. FIG. 3 is a flow chart showing the algorithm of the spectrum calculation processing program. FIG. 4 is a schematic diagram showing an example of the display screen of the plurality of spectrums acquired from the ion trap mass spectrometer 10 and the pre-selection integrated spectrum.

Figure 5:
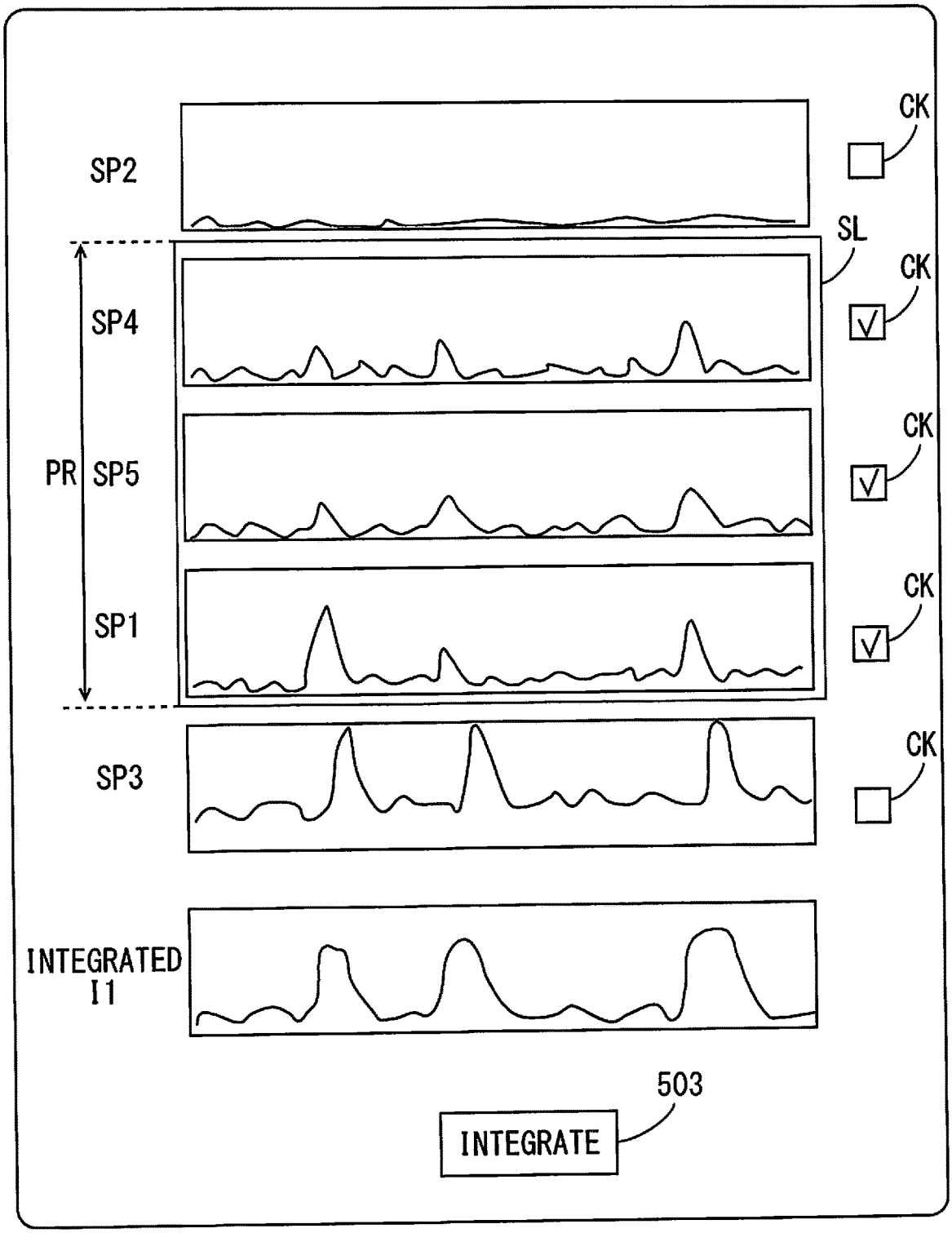
FIG. 5 is a schematic diagram showing an example of a display screen for explaining selection of a plurality of spectrums.
Figure 6:
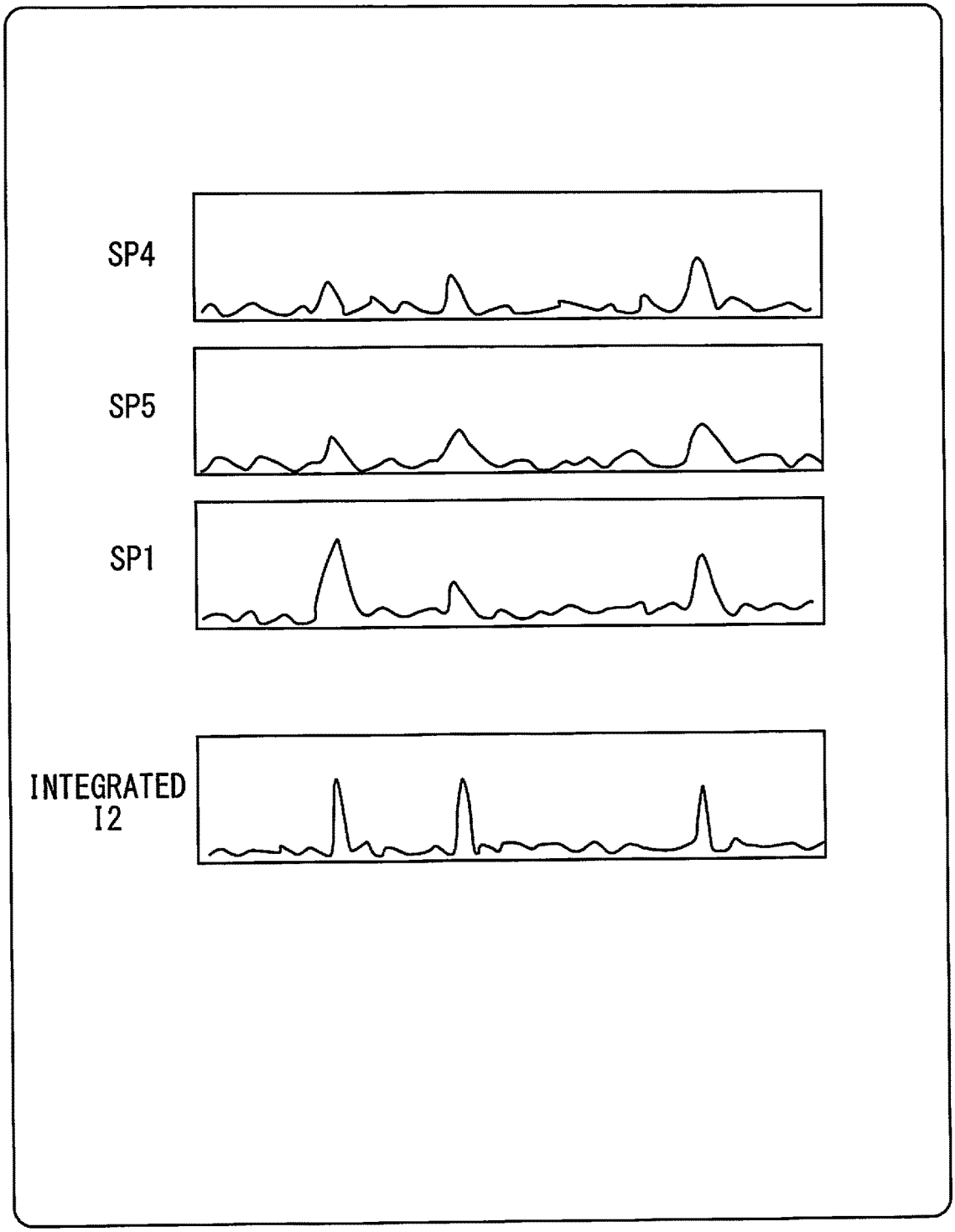
FIG. 6 is a schematic diagram showing an example of a display screen of the plurality of selected spectrums and a post-selection integrated spectrum.

FIG. 5 is a schematic diagram showing an example of the display screen for explaining the selection of a plurality of spectrums. FIG. 6 is a schematic diagram showing an example of the display screen of a plurality of selected spectrums and the post-selection integrated spectrum.

The ion trap mass spectrometer 10 of FIG. 1 carries out the analysis a plurality of times with respect to the same sample 12. Thus, a plurality of spectrums are obtained. As a first example, the ion trap mass spectrometer 10 obtains a plurality of spectrums with respect to the same sample 12 under the same condition. In this case, the laser irradiator 13 irradiates the same position in the sample 12 with laser light. Thus, the same portion of the sample 12 is consumed, so that the amount of ions that are produced each time the sample 12 is irradiated with laser light can gradually decrease. As a second example, the ion trap mass spectrometer 10 obtains a plurality of spectrums with respect to the same sample 12 by sequentially irradiating a plurality of different positions in the sample 12 with laser light. Due to the localization of the sample 12, the amount of ions that are produced each time the sample 12 is irradiated with laser light varies. In particular, when 2,5-dihydroxybenzoic acid (DHB) or the like is used as a matrix, the amount of ions differs largely according to the irradiated positions with laser light. As a third example, the ion trap mass spectrometer 10 obtains a plurality of spectrums by sequentially irradiating the sample 12 with laser light using the laser irradiator 13 with different power. In this case, the amount of ions that are produced each time the sample 12 is irradiated with laser light differs according to the power of laser light. A plurality of spectrums may be obtained with respect to the same sample 12 by combination of the first to third examples.

First, the spectrum acquirer 301 of FIG. 2 acquires a plurality of spectrums from the output unit 6 of the ion trap mass spectrometer 10 (step S1). Next, the pre-selection spectrum integrator 306 integrates the data of the plurality of spectrums acquired by the spectrum acquirer 301 (step S2). Thus, the pre-selection integrated spectrum is calculated. The display controller 310 allows the display 37 to display the pre-selection integrated spectrum calculated by the pre-selection spectrum integrator 306 (step S3).

In the display screen of FIG. 4, a plurality of spectrums SP1 to SP5 are displayed, and a pre-selection integrated spectrum 11 is displayed. The plurality of spectrums SP1 to SP5 are the spectrums respectively obtained when the different positions in the sample 12 are irradiated with the laser light. For example, the spectrum SP2 is the spectrum obtained when a position at which the sample 12 is hardly present is irradiated with the laser light. Therefore, a peak is hardly present. Further, the spectrum SP3 is the spectrum obtained when a position at which the sample 12 is excessively present is irradiated with the laser light. Therefore, each peak is saturated. As a result, each peak is deformed and widen in the pre-selection integrated spectrum 11.

The user designates the m/z range using the operation unit 36. Thus, the m/z range setter 307 sets the designated m/z range (step S4). In the example of FIG. 4, the m/z range is input in an m/z range field 502 by the user. Thus, the m/z range MR is set.

Next, the specific physical quantity calculator 302 calculates the specific physical quantity in the m/z range with respect to each spectrum (step S5). In the present embodiment, the specific physical quantity is an integral charge quantity, so that the specific physical quantity calculator 302 calculates the integral charge quantity in the m/z range MR with respect to each spectrum.

In the display screen of FIG. 4, the plurality of spectrums SP1 to SP5 and the pre-selection integrated spectrum 11 are displayed, and a sort instruction button 501 is displayed. When the user operates the sort instruction button 501, the spectrum sorter 303 sorts the plurality of spectrums based on the specific physical quantity calculated by the specific physical quantity calculator 302 (step S6). Further, the display controller 310 displays the plurality of sorted spectrums (step S7).

In the example of FIG. 4, the integral charge quantity with respect to the spectrum SP2 is the smallest, the integral charge quantity increases in the order of the spectrum SP4, SP5, SP1, and the integral charge quantity with respect to the spectrum SP3 is the largest. Therefore, the spectrums SP1 to SP5 are sorted in the order of the spectrums SP2, SP4, SP5, SP1, SP3 as shown in FIG. 5.

In the display screen of FIG. 5, checkboxes CK are displayed correspondingly to the spectrums SP1 to SP5 respectively. The user can designate a desired range of the specific physical quantity by checking checkboxes CK using the operation unit 36. Further, the user can designate a desired range of the specific physical quantity by putting a rectangular frame SL around a plurality of spectrums using the operation unit 36. Hereinafter, the designated range of the specific physical quantity is referred to as a selection range. In the example of FIG. 5, the selection range PR of the integral charge quantity is designated. Further, in the display screen of FIG. 5, an integration instruction button 503 is displayed.

The selection range setter 308 sets the designated selection range of the specific physical quantity (step S8). The spectrum selector 304 selects spectrums having specific physical quantities in the set selection range (step S9). In the example of FIG. 5, the spectrums SP4, SP5, SP1 are selected.

The display controller 310 allows the display 37 to display the plurality of spectrums selected by the spectrum selector 304 (step S10). When the user operates the integration instruction button 503 in the display screen of FIG. 5, the selected spectrums SP4, SP5, SP1 are displayed in the display screen of FIG. 6.

Further, the post-selection spectrum integrator 305 integrates the data of the plurality of selected spectrums (step S11). Thus, the post-selection integrated spectrum is calculated. The display controller 310 allows the display 37 to display the post-selection integrated spectrum (step S12). In the example of FIG. 6, the post-selection integrated spectrum 12 is displayed. In the post-selection integrated spectrum 12, each spectrum does not have deformation such as widening. The storage 309 stores the post-selection integrated spectrum, and the type and selection range of the specific physical quantity. In the present embodiment, the type of the specific physical quantity is the integral charge quantity.

(4) Effects of Embodiment

The spectrum calculation processing device 30 according to the present embodiment sorts the plurality of spectrums in the order of the specific physical quantity reflecting the amount of ions, and displays the plurality of spectrums in the sorted order. Thus, the user can identify the specific physical quantity range in which a good spectrum can be obtained by viewing the plurality of spectrums displayed in the order of the specific physical quantity. The plurality of spectrums having the specific physical quantities in the selection range designated by the user are selected, and the plurality of selected spectrums are integrated. Thus, a good post-selection integrated spectrum is obtained.

Generally, when the MALDI ion source is used, variations in amount of ions that are produced each time a sample is irradiated with laser light and production of ions in a wide range make influence by the space charges in the ion trap 2 be unstable. As a result, the value of the mass-to-charge ratio of each peak in a spectrum is unstable, or a plurality of peaks in the integrated spectrum are not sufficiently separated. Here, although such a spectrum is considered to be corrected, it is difficult to correct the spectrum due to the following reasons. First, because ion detection efficiency has mass dependency, it is difficult to calculate a correct amount of ions from a spectrum. Further, in the case where resonance excitation is used for discharge of ions from the ion trap 2, when the influence by space charges in the ion trap 2 becomes too large, the discharge of ions from the ion trap 2 changes from the resonance excitation discharge to the LMCO (Low Mass Cut off) discharge. In this case, the spectrum changes largely. Therefore, it is difficult to correct the spectrum accurately. As such, it is considered that the irradiated position with laser light and the power of laser light are adjusted such that influence by the space charges in the ion trap 2 is reduced. However, adjustment of the irradiated position with laser light and the power of laser light requires much labor or time. In particular, in consideration of consumption of the sample 12 due to continuous irradiation of the same position with laser light, the above-mentioned adjustment work requires even more labor or time.

In contrast, the spectrum calculation processing device 30 according to the present embodiment does not require the correction of a spectrum or the adjustment work of an irradiated position with laser light or the like. Therefore, a good post-selection integrated spectrum can be obtained easily based on the plurality of spectrums obtained by the ion trap mass spectrometry.

Further, because the post-selection integrated spectrum and the selection range of the specific physical quantity for obtaining the post-selection integrated spectrum are stored, a plurality of mass spectrums to be used for integration can be selected based on the stored selection range of the specific physical quantity at the time of analysis of another sample of the same type. Therefore, in the analysis that is carried out a plurality of times, the reference for selection of the plurality of spectrums to be used for integration is constant. Further, an analysis method including the selection range of the specific physical quantity as one of the analysis conditions can be created easily.

Further, the integral charge quantity used as the specific physical quantity sufficiently reflects the amount of ions in the ion trap 2, so that it is possible to obtain a good post-selection integrated spectrum by selecting a plurality of spectrums having integral charge quantities in an appropriate range.

(5) Other Embodiments

While the integral charge quantity is used as the specific physical quantity in the above-mentioned embodiment, another physical quantity reflecting the amount of ions may be used as the specific physical quantity. For example, the total height of one or a plurality of peaks in the specific m/z range of the spectrum may be used as the specific physical quantity. When the space charges quantity in the ion trap 2 is large, the height and width of a peak in a spectrum tend to be large. Thus, the height of the peak reflects the amount of ions. Therefore, even when the total height of the one or plurality of peaks in the specific m/z range is used as the specific physical quantity, a good post-selection integrated spectrum can be obtained.

While the ion source 1 is the MALDI ion source in the above-mentioned embodiment, the present invention is not limited to this. For example, the ion source 1 may be an ion source using Electrospray Ionization (ESI) or an ion source using Atmospheric Pressure Chemical Ionization (APCI).

While the ion trap mass spectrometer 10 according to the above-mentioned embodiment is a MALDI-DIT-MS, the present invention is not limited to this. For example, the present invention is applicable to another ion trap mass spectrometer such as an Ion Trap Time of Flight (IT-TOF: Time of Flight) mass spectrometer.

While the ion detector 5 using a secondary electron multiplier is used in the above-mentioned embodiment, the ion detector in the present invention is not limited to this. The ion detector in the present invention may be another ion detector such as an ion detector using a multi-channel plate.

In the above-mentioned embodiment, the spectrum acquirer 301 saves a plurality of spectrums that are obtained each time a sample is irradiated with laser light. However, when the amount of data to be saved is large, every certain number of spectrums out of a plurality of spectrums acquired by the spectrum acquirer 301 may be integrated, data processing such as moving average may be performed on each integrated spectrum, and each spectrum on which the data processing has been performed may be saved.

As each of various elements recited in the claims, various other elements having configurations or functions described in the claims can be also used.

While preferred embodiments of the present invention have been described above, it is to be understood that variations and modifications will be apparent to those skilled in the art without departing the scope and spirit of the present invention. The scope of the present invention, therefore, is to be determined solely by the following claims.

I claim:

1. A spectrum calculation processing device, comprising:

a spectrum acquirer that acquires a plurality of mass spectrums obtained by ion trap mass spectrometry with respect to a same sample;

a specific physical quantity calculator that calculates a physical quantity reflecting an amount of ions as a specific physical quantity with respect to each of the plurality of mass spectrums acquired by the spectrum acquirer;

a spectrum sorter that sorts the plurality of mass spectrums in order of the specific physical quantity calculated with respect to each mass spectrum;

a first display controller that allows a display to display the plurality of mass spectrums sorted by the spectrum sorter;

a spectrum selector that selects a plurality of mass spectrums each having an integral charge quantity in a designated range or a total height of at least one peak in the designated range from the plurality of mass spectrums displayed on the display by the first display controller;

a spectrum integrator that integrates the plurality of mass spectrums each having the integral charge quantity or total height of at least one peak in the designated range and selected by the spectrum selector; and a second display controller that allows the display to display an integrated mass spectrum obtained by the spectrum integrator, wherein the specific physical quantity includes an integral charge quantity in a specific mass-to-charge ratio range with respect to each of the mass spectrums acquired by the spectrum acquirer or a total height of at least one peak in the specific mass-to-charge ratio range with respect to each of the mass spectrums acquired by the spectrum acquirer.

2. The spectrum calculation processing device according to claim 1, further comprising:

a storage that stores the mass spectrum obtained by the spectrum integrator, and the designated range in selection of the plurality of mass spectrums by the spectrum selector.

3. The spectrum calculation processing device according to claim 1, wherein the specific physical quantity is the integral charge quantity or total height of the at least one peak in the specific mass-to-charge ratio range with respect to each mass spectrum.

4. The spectrum calculation processing device according to claim 1, further comprising:

a mass-to-charge ratio range setter that sets a specific mass-to-charge ratio range.

5. A spectrum calculation processing method, including:

acquiring a plurality of mass spectrums obtained by ion trap mass spectrometry with respect to a same sample;

calculating a physical quantity that reflects an amount of ions as a specific physical quantity with respect to each of the plurality of mass spectrums acquired with respect to the same sample;

sorting the plurality of mass spectrums in order of the specific physical quantity calculated with respect to each mass spectrum;

allowing a display to display the plurality of mass spectrums sorted in order of the specific physical quantity calculated with respect to each mass spectrum;

selecting a plurality of mass spectrums each having an integral charge quantity in a designated range or a total height of at least one peak in the designated range from the plurality of mass spectrums displayed on the display;

integrating the plurality of mass spectrums each having the integral charge quantity or total height of at least one peak in the designated range and selected in the designated range; and allowing the display to display an integrated mass spectrum, wherein the specific physical quantity includes an integral charge quantity in a specific mass-to-charge ratio range with respect to each of the mass spectrums acquired by the spectrum acquirer or a total height of at least one peak in the specific mass-to-charge ratio range with respect to each of the mass spectrums acquired by the spectrum acquirer.

6. A non-transitory computer readable medium storing a spectrum calculation processing program, the spectrum calculation processing program causing a computer to execute:

a process of acquiring a plurality of mass spectrums obtained by ion trap mass spectrometry with respect to a same sample;

a process of calculating a physical quantity that reflects an amount of ions as a specific physical quantity with respect to each of the plurality of mass spectrums acquired with respect to the same sample;

a process of sorting the plurality of mass spectrums in order of the specific physical quantity calculated with respect to each mass spectrum;

a process of allowing a display to display the plurality of mass spectrums sorted in order of the specific physical quantity calculated with respect to each mass spectrum;

a process of selecting a plurality of mass spectrums each having an integral charge quantity in a designated range or a total height of at least one peak in the designated range from the plurality of mass spectrums displayed on the display;

a process of integrating the plurality of mass spectrums each having the integral charge quantity or total height of at least one peak in the designated range and selected in the designated range; and a process of allowing the display to display an integrated mass spectrum;

wherein the specific physical quantity includes an integral charge quantity in a specific mass-to-charge ratio range with respect to each of the mass spectrums acquired by the spectrum acquirer or a total height of at least one peak in the specific mass-to-charge ratio range with respect to each of the mass spectrums acquired by the spectrum acquirer.

7. An ion trap mass spectrometry system, comprising:

an ion trap spectrometer; and the spectrum calculation processing device of claim 1, that performs calculation processing with respect to a plurality of mass spectrums obtained by the ion trap mass spectrometer.

8. An ion trap mass spectrometry method, comprising:

obtaining a plurality of mass spectrums by ion trap mass spectrometry with respect to a same sample; and performing the spectrum calculation processing method of claim 5 with respect to the plurality of mass spectrums obtained by ion trap mass spectrometry with respect to the same sample.

9. The spectrum calculation processing device according to claim 1, wherein the specific physical quantity is the integral charge quantity in the specific mass-to-charge ratio range with respect to each mass spectrum.

10. The spectrum calculation processing device according to claim 2, further comprising:

a mass-to-charge ratio range setter that sets a specific mass-to-charge ratio range.

11. The spectrum calculation processing device according to claim 3, further comprising:

a mass-to-charge ratio range setter that sets a specific mass-to-charge ratio range.

12. The spectrum calculation processing device according to claim 4, further comprising:

a mass-to-charge ratio range setter that sets a specific mass-to-charge ratio range.

13. A spectrum calculation processing device, comprising:

circuitry configured to acquire a plurality of mass spectrums obtained by ion trap mass spectrometry with respect to a same sample, calculate a physical quantity reflecting an amount of ions as a specific physical quantity with respect to each of the plurality of mass spectrums acquired by the circuitry, sort the plurality of mass spectrums in order of the specific physical quantity calculated with respect to each mass spectrum, allow the display to display the plurality of mass spectrums sorted by the circuitry, select a plurality of mass spectrums each having an integral charge quantity in a designated range or a total height of at least one peak in the designated range from the plurality of mass spectrums displayed on the display by the circuitry, integrate the plurality of mass spectrums each having the integral charge quantity or total height of at least one peak in the designated range and selected by the circuitry, and allow the display to display integrated mass spectrum obtained by the circuitry, wherein the specific physical quantity includes an integral charge quantity in a specific mass-to-charge ratio range with respect to each of the mass spectrums acquired by the spectrum acquirer or a total height of at least one peak in the specific mass-to-charge ratio range with respect to each of the mass spectrums acquired by the spectrum acquirer.

14. The spectrum calculation processing device according to claim 13, wherein the circuitry is configured to store the mass spectrum obtained, and the designated range in selection of the plurality of mass spectrums.

15. The spectrum calculation processing device according to claim 13, wherein the specific physical quantity is the integral charge quantity or total height of the at least one peak in the specific mass-to-charge ratio range with respect to each mass spectrum.

16. The spectrum calculation processing device according to claim 13, wherein the circuitry is configured to set a specific mass-to-charge ratio range.

17. The spectrum calculation processing device according to claim 13, wherein the specific physical quantity is the integral charge quantity in the specific mass-to-charge ratio range with respect to each mass spectrum.

18. The spectrum calculation processing device according to claim 14, wherein the circuitry is configured to set a specific mass-to-charge ratio range.

19. The spectrum calculation processing device according to claim 15, wherein the circuitry is configured to set a specific mass-to-charge ratio range.

20. The spectrum calculation processing device according to claim 13, wherein the circuitry includes an input output I/F, a CPU, a RAM, a ROM and a storage device.

* * * * *